US006701531B1

(12) United States Patent
Hayden

(10) Patent No.: US 6,701,531 B1
(45) Date of Patent: Mar. 9, 2004

(54) CORSAGE AND WRISTLET BASE AND METHOD

(76) Inventor: Nancy Mae Hayden, 7961 Graylodge Ct., Sacramento, CA (US) 95828

( * ) Notice: Subject to any disclaimer, the term of this patent is extended or adjusted under 35 U.S.C. 154(b) by 0 days.

(21) Appl. No.: 10/131,456

(22) Filed: Apr. 20, 2002

(51) Int. Cl.[7] ..... A41D 19/00
(52) U.S. Cl. ..... 2/162; 428/15
(58) Field of Search ..... 2/162, 1, 244; 428/15, 7, 542.2; D11/43; D24/6; 63/3

(56) References Cited

U.S. PATENT DOCUMENTS

| | | | | | |
|---|---|---|---|---|---|
| 174,364 | A | * | 3/1876 | Hurdle | |
| 1,488,841 | A | * | 4/1924 | Scott | |
| 2,145,531 | A | * | 1/1939 | Shuko | |
| 2,787,819 | A | * | 4/1957 | Kaher | |
| 3,134,151 | A | * | 5/1964 | Conlin | |
| 3,416,195 | A | * | 12/1968 | Borthwick | |
| 3,760,460 | A | * | 9/1973 | Myers | |
| 4,091,567 | A | * | 5/1978 | Higdon et al. | |
| 4,229,877 | A | * | 10/1980 | Fagan | |
| 4,888,221 | A | * | 12/1989 | Tischer | |
| D334,905 | S | * | 4/1993 | Ritz | |
| 5,236,748 | A | * | 8/1993 | Cheng | 428/26 |
| D350,312 | S | * | 9/1994 | Edwards | |
| D350,313 | S | * | 9/1994 | Edwards | |
| 5,836,017 | A | * | 11/1998 | Hironaga et al. | 2/69 |
| 6,074,712 | A | * | 6/2000 | Ramirez | 428/4 |
| 6,151,831 | A | * | 11/2000 | Weder et al. | 47/72 |
| 6,389,649 | B1 | * | 5/2002 | Metzler | 24/6 |

FOREIGN PATENT DOCUMENTS

GB 2246063 A * 1/1992 ..... A45F/5/08

OTHER PUBLICATIONS

Internet Article Making Corsage Accessories www.hort.vt-.edu/faculty/McDaniel/hort2164/ R9MakingCorsageAccessories.htm.*

* cited by examiner

*Primary Examiner*—Katherine Moran
(74) *Attorney, Agent, or Firm*—Risto A. Rinne, Jr.

(57) ABSTRACT

A method and apparatus to create corsage or wristlet types of floral arrangements includes a planar base member having a preferred ornamental shape to which a length of ribbon is attached. A length of fabric netting is gathered and is attached to the base member on top of, or simultaneously along with, the ribbon. The gathered fabric netting is trimmed as desired to provide preferably an oval three-dimensional shape, thereby completing the assembly of the apparatus. In use, the bottom of a plurality of blooms are dipped in a floral adhesive and pressed into the fabric netting to which they adhere until the entire fabric netting is sufficiently covered with blooms. The ribbon is used to tie the arrangement around a wrist or the excess ribbon is cut off and a decorative pin is used to secure the base member to a garment.

13 Claims, 1 Drawing Sheet

CORSAGE AND WRISTLET BASE AND METHOD

BACKGROUND OF THE INVENTION

1. Field of the Invention

The present invention, in general, relates to small bouquets which include either corsages or floral wristlets, and more particularly to a product and method for making a base that is then used to make either a pin-on corsage or a wristlet.

Corsages and floral wristlets (hereinafter referred to as a "wristlet(s)" are well known types of small floral bouquets that are either pinned onto a garment (i.e., in the case of a corsage) or are secured around a wrist of wearer with a band (i.e., in the case of a wristlet).

Corsages and wristlets are made primarily by florists. They are typically worn at gala events, parties, balls and the like. Currently, the trend is toward the increasing use of wristlets in favor of corsages. Approximately ninety percent of the floral arrangements that are worn at high school proms, for example, include wristlets worn by ladies.

It is perceived as a sign of respect and consideration, possibly even affection, for a gentleman to provide either a corsage or a wristlet to a lady prior to attending such types of events.

Both types of floral arrangements are similar in structure, however the wristlet includes a band that is passed around the wrist and it secured in place near the hand whereas the corsage does not include the band but it is instead pinned to the garment usually somewhere on the upper torso.

While both corsages and wristlets are well-liked devices, there are several problems associated with their manufacture.

First, it is time consuming for a florist to make either product. Typically, the stems of many flowers are presently cut so as to include a small portion of the stem with each bloom. A fine retaining wire is wrapped around the stem of each flower and is then secured to a specially designed base. One type of base includes a band for use as a wristlet and another type of base is adapted for pinning to the garment. A number of flowers are used, which means that many wires must be wrapped around many stems and then each flower (bloom) must in turn be secured to the base, typically by also wrapping and attaching a portion of the wire to each base.

This is a time-consuming process taking a skilled florist approximately 25 minutes to complete each wristlet. The time required adds considerably to the cost.

Furthermore, the wrapping of the wire around each stem is a repetitive motion that is potentially damaging and may lead to fatigue and possibly even to carpal tunnel syndrome Also, it is generally regarded as too difficult for members of the general public to fabricate (i.e., to make) their own corsages or wristlets. Accordingly, there is a need for an inexpensive kit that individuals can purchase that would then allow them to cut flowers from their own flower beds or purchase them as desired, and then use the blooms to easily make their own corsages or wristlets.

Accordingly, there exists today a need for a corsage and wristlet base and method that saves time and motion when used to make a corsage or a wristlet and which can be used by commercial florists as well as by individuals.

Clearly, such an apparatus would be a useful and desirable device.

2. Description of Prior Art

Corsages and the like are, in general, known. For example, the following patents describe various types of these devices:

U.S. Pat. No. 5,786,043 to Lindgren, Jul. 28, 1998;
U.S. Pat. No. 5,120,583 to Garcia, Jun. 9, 1992;
U.S. Pat. No. 4,525,394 to Standley, Jun. 25, 1985;
U.S. Pat. No. 4,011,677 to Higdon et al., Mar. 15, 1977;
U.S. Pat. No. 3,452,476 to Kise, Jul. 1, 1969;
U.S. Pat. No. 3,416,195 to Borthwick, Dec. 17, 1968,
U.S. Pat. No. 3,243,336 to Auge, Mar. 29, 1966;
U.S. Pat. No. 3,142,100 to Shoemaker, Jul. 28, 1964;
U.S. Pat. No. 2,787,819 to Kaber, Apr. 9, 1957;
U.S. Pat. No. 2,771,695 to James, Nov. 27, 1956;
U.S. Pat. No. 2,741,049 to Meldrum, Apr. 10, 1956;
U.S. Pat. No. 2,593,797 to Robbins, Apr. 22, 1952; and
U.S. Des. Pat. No. 409,522 to Satterfield et al., May 11, 1999.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a corsage and wristlet base and method that is inexpensive to manufacture.

It is also an important object of the invention to provide a corsage and wristlet base and method that is easy to use.

Another object of the invention is to provide a corsage and wristlet base and method that can be used to fabricate a corsage.

Still another object of the invention is to provide a corsage and wristlet base and method that can be used to fabricate a wristlet.

Still yet another object of the invention is to provide a corsage and wristlet base and method that saves time in the fabrication of a corsage.

Yet another important object of the invention is to provide a corsage and wristlet base and method that saves time in the fabrication of a wristlet.

Still yet another important object of the invention is to provide a corsage and wristlet base and method that eliminates the need for repetitive wrapping of a length of wire around the stem of a flower.

A first continuing object of the invention is to provide a corsage and wristlet base and method that can be used by florists to make either corsages or wristlets.

A second continuing object of the invention is to provide a corsage and wristlet base and method that can be sold to individuals, including hobbyists as well as the general public, to make either corsages or wristlets.

A third continuing object of the invention is to provide a corsage and wristlet base and method that is adapted to seal the end of each bloom.

A fourth continuing object of the invention is to provide a corsage and wristlet base and method that is adapted to prolong the useful life of either a corsage or a wristlet.

Briefly, a corsage and wristlet base and method that is constructed in accordance with the principles of the present invention has a base member that preferably includes an ornamental appearance and is smooth, upon which a length of ribbon is placed and is attached to the base member. The ribbon serves as a securing band. A section of fabric netting is gathered and, if preferred, tied so as to keep it in a gathered state. The gathered fabric netting is placed on top of the base member and attached thereto. The gathered fabric netting is then trimmed to remove the creases and folds and give it a smooth contour that preferably resembles one-half of a three-dimensional oval, with the flat side thereof disposed on the base member. This concludes formation of the corsage and wristlet base. To subsequently use the corsage and wristlet base (i.e., a method to fabricate either a corsage or a wristlet), a plurality of flowers are used, the stem being removed from each so as to leave only the head of each flower including the bloom. The underside of the head of each flower is dipped into a glue and is then inserted into the fabric netting. The glue commingles with the fabric netting as it dries thereby securing the bloom to the fabric netting, sealing the end of the bloom, and thereby helping to prolong its appearance by retarding the drying thereof. This process is repeated until the fabric netting is filled with blooms and the result is either a corsage or a wristlet. The band is used to tie the resultant wristlet about the wrist of the wearer. If the finished product is to be used as a corsage, the band is trimmed on each end of the base member so as to remove any excess that protrudes therefrom. The base member is then pinned to the garment of the wearer.

DETAILED DESCRIPTION OF THE INVENTION

Figure 1:
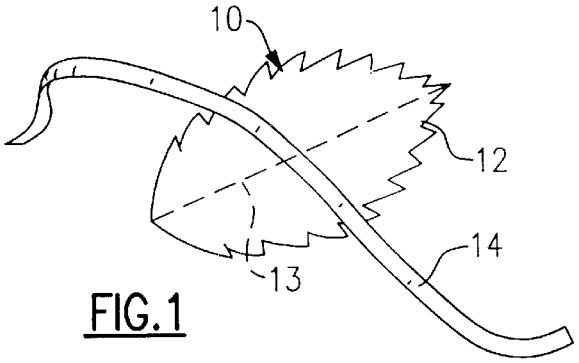
FIG. 1 is a base member of the instant corsage and wristlet base and method with a band attached thereto.

Referring to the drawing FIGURES and in particular to FIG. 1, is shown, a corsage and wristlet base and method, identified in general by the reference numeral 10.

A base member 12 is provided that includes a substantially planar structure that can be bent as preferred during use. Preferably, it includes an ornamental shape and is made of an especially smooth material.

The base member 12, as shown, is preferably formed of a satin or satin-like material and resembles a leaf in appearance, this shape being consistent with flowers and plants, generally.

The base member 12 may also include a longitudinal wire 13 (dashed line, as shown) that is disposed along its length so as to add rigidity thereto.

Satin is but one material that is preferred for use as the base member 12 because it is smooth and feels nice when it contacts the skin of wearer, as is described in greater detail hereinafter.

Other materials for use as the base member 12 include any smooth fabric, such as felt, silk, or any other material, as is desired or available. The base member 12 can be formed of any material as desired, including plastic as one example thereof. It is preferred, however, that such a base member 12 be covered with a smooth and attractive fabric, to improve aesthetics and feel.

A length of ribbon 14 is placed atop the base member 12 and is glued (i.e., attached) in place. The ribbon 14 serves as a band for attaching a finished wristlet, as is described in greater detail hereinafter.

Other methods of attaching the ribbon and of attaching other components (to be described hereinbelow) are discussed hereinafter as are possible variations in the manufacturing sequence where, for example, the ribbon 14 can be attached somewhat later, if desired, and concurrent with certain other component parts.

Figure 2:
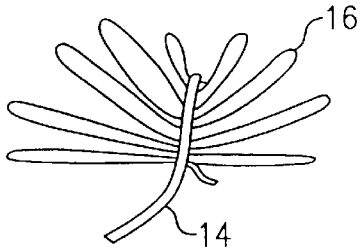
FIG. 2 is a fabric netting being gathered and tied.

Referring now to FIG. 2, a length of fabric netting 16 has been folded back and forth length-wise so as to gather it into a compact mass. The ribbon 14 or another length of ribbon (not shown) is used to tie and therefore retain the gathered fabric netting 16 as it was gathered.

Figure 4:
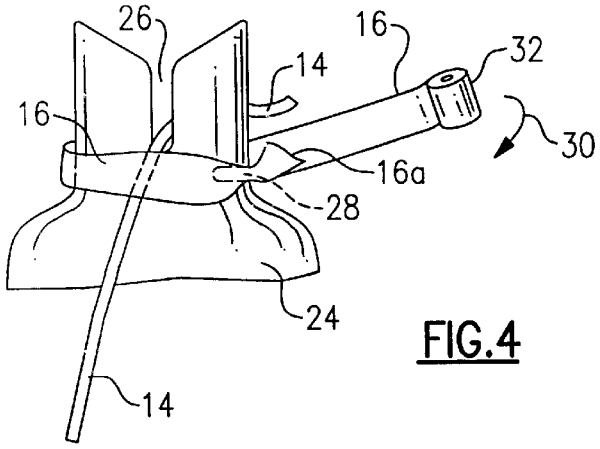
FIG. 4 is a tool for gathering the fabric netting of FIG. 2.

The possible use of the ribbon 14 to secure the fabric netting 16 in a gathered state is described in greater detail hereinafter. Such use is shown in FIG. 4.

The fabric netting 16 is formed of any preferred size and type of flexible material. A preferred material for use as the fabric netting is called "tulle" and is well known in the sewing arts. The width of the fabric netting 16 must be at least as wide as the base member 12 so that it is capable of overlapping it when it is gathered.

Figure 3:
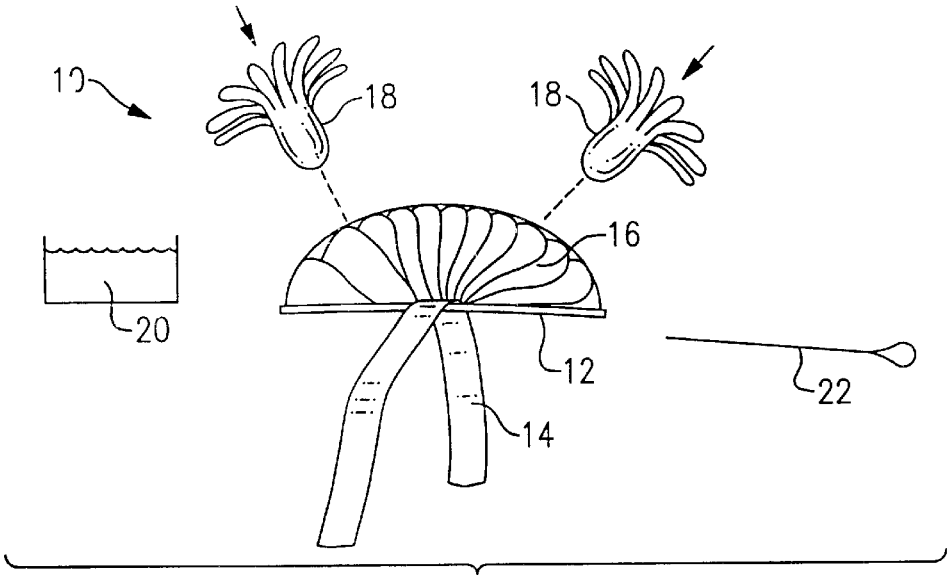
FIG. 3 is the fabric netting of FIG. 2 having been trimmed and attached to the base member of FIG. 1 and bloom.

Referring now to FIG. 3 the gathered fabric netting 16 is placed on the base member 12 and is glued thereto. The fabric netting 16 is then trimmed, such as with a pair of scissors (not shown), to remove the folds and creases of the fabric netting 16 and attain a smooth contour as is shown in FIG. 3.

Any apparent three dimensional shape can be sculpted into the fabric netting 16, as desired. A preferred finished shape for the fabric netting 16, after trimming, resembles one-half of a three-dimensional oval with the flat side being disposed on the base member 12.

The generally oval shape for the trimmed fabric netting 16 covers the generally oval shaped (i.e., leaf-like) base member 12 and is aesthetically well suited for use around a wrist. If the shape of the base member 12 were modified, the overall shape of the trimmed fabric netting 16 would also be modified so as to correspond generally with that of the modified base (not shown).

This concludes fabrication of the corsage and wristlet base and method 10, which can then be used to form either a corsage or a wristlet. A modification to the method for fabricating the corsage and wristlet base 10 is described hereinafter.

The same corsage and wristlet base and method 10 can now be used to create either a corsage or a wristlet, whichever is desired. To begin, the stems are preferably removed from a plurality of flowers so as to leave only the blooms 18 (i.e., the head or blossom portion of each flower).

The lower portion of each bloom 18 is then dipped into a floral adhesive 20 and is then placed where desired on the fabric netting 16, to which it adheres. Each bloom 18, after dipping in the floral adhesive 20, is pushed sufficiently far into the fabric netting 16. Once a sufficient number of blooms 18 have been placed, the fabric netting is covered by the blooms 18 and a beautiful floral arrangement is provided that can be used either as a corsage or as a wristlet.

For use as a wristlet, the base member is placed atop a wrist (not shown) and the ribbon 14 is allowed to encircle the wrist where both ends of the ribbon 14 are fastened together and, preferably secured in a bow or other knot, thereby securing the wristlet in place proximate the wrist.

For use as a corsage, the excess length of the ribbon 14 that extends beyond each side of the base member 12 is trimmed so that it is flush with the base member 12. The base member 12 is then secured to a garment (not shown) by passing a decorative pin 22 through the base member 12 and the garment and then back out of the garment and again through an opposite side of the base member 12.

For the commercial florist, a quantity of the corsage and wristlet base and methods 10 are supplied and because they can be used to create either corsages or wristlets, inventory is simplified (no need for two different components, one to make wristlets and the other to make corsages). The commercial florist typically already has amply supplies of the floral adhesive 20 or can obtain what is needed.

As a consumer kit, the assembled corsage and wristlet base and method 10 could be sold as a product along with a small supply of the floral adhesive 20, sufficient to create the floral corsage or wristlet arrangement, and instructions for use. It is even possible to include the component parts and instructions necessary to fabricate the corsage and wristlet base 10 as part of a modified consumer kit, for those individuals who would prefer to do as much of the work as possible themselves.

An unexpected benefit derived by the instant invention, beyond the ease of assembly, is that the finished product (either the corsage or the wristlet) lasts longer. The reason it lasts longer is because the floral adhesive 20, when it dries, provides a water (i.e., vapor) barrier that surrounds the end and which also extends over a portion of the head of each bloom 18. The resultant vapor barrier retards (i.e., slows) the rate of escape of water vapor from the bloom 18 which prevents it from drying prematurely.

Consequently, the flowers (i.e., the blooms 18) retain a fresh, healthy look longer than when conventional (i.e., wire-wrapped) assembly methods for corsages or wristlets are used. Not only is it faster, less expensive, and considerably easier to fabricate either a corsage or a wristlet by using the corsage and wristlet base 10, but the finished product maintains its attractive appearance for a longer time.

Referring now to FIG. 4, is shown a tool 24 for quickly folding (i.e., gathering) the fabric netting 16. The tool 24 is a simple, inexpensive component that can be used by both commercial florists as well as by the individual consumer. Accordingly, it optionally can be included in any retail kit or it can, alternatively, be sold as an accessory item. The tool 24 is formed of a thin planar piece of material, preferably plastic.

The tool 24 includes a first notch 26 disposed on a first end into which is first placed the ribbon 14 so that approximately ⅓ of the ribbon 14 is disposed on one side of the tool 24 and the remaining ⅔ of the ribbon 14 is disposed on an opposite side thereof. The ribbon 14 is retained within the first notch 26 by friction.

On a side that is substantially perpendicular with respect to the first end, a second notch 28 is provided into which a first end 16*a* of the fabric netting 16 is placed. The fabric netting 16 is retained by friction within the second notch 28.

The fabric netting 16 is then wrapped around the tool 24 repeatedly (see arrow 30) so that it passes over the ribbon 14 on only one side of the tool 24. The fabric netting 16 passes over the ribbon 14 with each subsequent pass. A predetermined number of passes (i.e., wraps) are made around the tool 24 until a desired quantity and density of the fabric netting 16 is attained.

The remaining end of the fabric netting 16 is then cut. As shown, the remaining end is attached to a roll 32, from which the desired quantity is drawn. The ribbon 14 is then pulled tightly around the fabric netting 16 and is tied, thereby retaining the fabric netting 16 in a gathered state.

This forms an assembly that includes the gathered fabric netting 16 and the ribbon 14. The assembly is then placed directly upon the base member 12 and is secured thereto by gluing (or by other fastening methods as described hereinafter). The floral adhesive 20 or another type of adhesive (not shown) may be used, as desired.

The creation of the assembly, as described, eliminates one step in the formation of the corsage and wristlet base and method 10. The step by step approach of creating the corsage and wristlet base and method 10, as was described earlier, included attaching (i.e., gluing) first the ribbon 14 which was then followed by attaching the gathered fabric netting 16 to the base member 12. When the ribbon 14 is used to secure the gathered fabric netting 16 one step is eliminated, because both the ribbon 14 and the fabric netting 16 are attached simultaneously to the base member 12.

While gluing is preferred, the instant invention is intended to encompass any method for attaching the ribbon 14 or fabric netting 16 to the base member 12 including, but not limited to, sewing or the use of a hook and loop fastener as well as other methods of attachment that are generally known.

The gathered fabric netting 16 is then trimmed to obtain the desired oval (or other) shape on top. The tool 24 allows for the rapid creation of the ribbon 14 and gathered fabric netting 16 assembly and therefore helps to facilitate manufacture of the corsage and wristlet base and method 10.

It is anticipated that when large scale manufacture of the corsage and wristlet base and method 10 occurs, other machines and devices (not shown) will be created to facilitate any aspect of the manufacture of the corsage and wristlet base and method 10.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A corsage and wristlet base, comprising:

(a) a base member wherein said base member includes a substantially planar structure that is not open in a center thereof; and (b) a fabric that is attached to said base member;

and wherein said fabric includes a quantity of gathered fabric and wherein a portion thereof is removed sufficient to provide a three-dimensional shape to a remaining quantity of gathered fabric and wherein said three-dimensional shape includes one-half of an oval and including means adapted for retaining at least one bloom proximate said remaining quantity of gathered fabric and wherein said means adapted for retaining said at least one bloom includes an adhesive.

2. The corsage and wristlet base of claim 1 wherein said base member includes means for increasing the rigidity of said base member.

3. The corsage and wristlet base of claim 2 wherein said means for increasing the rigidity of said base member includes a wire that is attached to said base member.

4. The corsage and wristlet base of claim 1 including means for attaching said base member to an object.

5. The corsage and wristlet base of claim 4 wherein said means for attaching includes a ribbon, said ribbon attached to said base member and wherein said ribbon is adapted to retain said base member proximate a wrist of a person.

6. The corsage and wristlet base of claim 4 wherein said means for attaching includes a pin, said pin adapted to pass through said base member and wherein said pin is adapted to attach said base member to a garment.

7. The corsage and wristlet base of claim 1 wherein said fabric includes a fabric netting.

8. The corsage and wristlet base of claim 7 wherein said fabric netting includes tulle.

9. A method for making a base wherein said base is adapted to fabricate a corsage or a wristlet, said method comprising the steps of:

(a) providing a base member wherein said base member includes a substantially planar structure that is not open in a center thereof;

(b) gathering a fabric and attaching a said fabric to said base;

(c) trimming at least a portion of said fabric;

(d) and providing an adhesive that is adapted to secure at least one bloom to said fabric.

10. The method of claim 9 including the step of attaching a ribbon to said base.

11. The method of claim 10 including the step of removing at least a portion of a length of said ribbon that extends away from said base.

12. The method of claim 9 including the step of attaching at least one bloom to said fabric by dipping a portion of said at least one bloom in said adhesive and then inserting a portion of said at least one bloom that includes said adhesive in said fabric.

13. The method of claim 12 including the step of attaching said base to an object after the step of attaching at least one bloom to said fabric.

* * * * *